US006215109B1

(12) United States Patent
Bolyard, Jr.

(10) Patent No.: US 6,215,109 B1
(45) Date of Patent: Apr. 10, 2001

(54) HOT MELT APPLICATOR AIR PREHEATER

(75) Inventor: Edward W. Bolyard, Jr., Old Hickory, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/432,952

(22) Filed: Nov. 3, 1999

(51) Int. Cl.[7] ..... H05B 3/06; B05B 1/24
(52) U.S. Cl. ..... 219/540; 239/135
(58) Field of Search ..... 219/539, 540, 219/553; 239/127.3, 135, 398, 405, 406, 296, 297

(56) References Cited

U.S. PATENT DOCUMENTS 4,065,057 * 12/1977 Durmann ..... 239/135
4,230,278 * 10/1980 Reed ..... 239/427.5
4,687,137 * 8/1987 Boger et al. ..... 239/124
5,533,675 * 7/1996 Benecke et al. ..... 239/413
5,618,566 * 4/1997 Allen et al. ..... 425/7
5,728,219 * 3/1998 Allen et al. ..... 118/315
5,746,047 * 5/1998 Steyer et al. ..... 239/127.3
5,862,986 * 1/1999 Bolyard, Jr. et al. ..... 239/135

* cited by examiner

*Primary Examiner*—Sang Paik
(74) *Attorney, Agent, or Firm*—Donald J. Breh; Marc W. Croll; John P. O'Brien

(57) ABSTRACT

An air preheater system, and a method of operating the same, for use in connection with the requisite supply of heated air streams to the dispensing modules of apparatus for dispensing hot melt adhesives comprises the initial separation of the incoming ambient relatively cool air into separate air streams. The separate air streams are then individually and separately heated, and the exiting or discharged heated air streams are then recombined into a single heated air stream. In this manner, any variations in the temperature levels, density, and flow rate parameters within the individual or separate heated air streams are therefore averaged out and effectively eliminated. The single heated air stream is then conducted to a distribution manifold wherein unique structure of the distribution manifold renders uniform distribution of the separate air streams to the hot melt adhesive dispensing modules possible. In addition, in order to properly control the temperature level to which the individual air streams are initially heated, a temperature sensor is placed within the single combined air stream at a location upstream of the distribution manifold.

28 Claims, 4 Drawing Sheets

HOT MELT APPLICATOR AIR PREHEATER

FIELD OF THE INVENTION

The present invention relates generally to hot melt adhesive application systems, and more particularly to a new and improved system or arrangement, and a method, for heating incoming air used to fiberize or determine the control pattern of the adhesive conveyed to the adhesive spray modules and dispensed therefrom.

BACKGROUND OF THE INVENTION

In connection with the spraying, dispensing, or discharge of hot melt adhesive materials, air is routed to the spray modules in order to control the particular patterns of the adhesives being dispensed. More specifically, such air is preheated so as to maintain the adhesive in its heated state such that the hot melt adhesive can properly achieve its adhesive functions. If cooled or ambient air was employed, the hot melt adhesive would experience an inappropriate amount of cooling whereby the utility of the adhesive would be lost. It has also been found to be imperative that the preheated air provided to the plurality of adhesive spray modules be uniform in temperature, density, and flow rate parameters in order to ensure uniformity of the resulting adhesive spray patterns from the adhesive spray modules. Currently, two basic air preheater design systems or arrangements are conventionally in use, however, each one of such systems or arrangements exhibits inherent operational drawbacks or disadvantages.

For example, as disclosed within FIG. 1, a first conventionally known and utilized system is illustrated, is generally indicated by the reference character 10, and is seen to comprise a conduit 12 for introducing incoming air into a heater block 14 within which a plurality of heaters 16,16 are serially disposed. Each one of the heaters 16 may take the form of a conventional spiral tube heater which is illustrated in FIG. 5. As seen in FIG. 5, each one of the heaters 16 comprises an outer housing 18 within which is disposed a hollow aluminum tubular member 20. Tubular member 20 is open at a first left end portion 22 thereof, while the second op-posite right end portion thereof is closed by means of an end face or wall 24 integral with the tubular member 20. The open end portion 22 of the tubular member 20 is provided with an external flanged portion 26 within which a O-ring type seal member 28 is disposed, and the outer peripheral surface of the tubular member 20 is provided with a helical thread or finned structure 30 which extends substantially the entire axial length of the tubular member 20 from within the vicinity of the flanged portion 26 to within the vicinity of the end face or wall 24. An air inlet port 32 is defined within a first sidewall portion of the housing 18 at an axial position adjacent to the flanged portion 26 so as to introduce relatively cool air CAI into the housing 18, and an air outlet port 34 is similarly defined within a second sidewall portion of the housing 18 at an axial position adjacent to the end wall or face 24 so as to permit heated air HAO to exit. It is of course to be appreciated that the helical thread or finned structure 30 cooperates with the interior peripheral surface of the housing 18 so as to in effect define a helical path or conduit along which the air is conducted from the air inlet port 32 to the air outlet port 34. The helical path or conduit provides increased residence time for the air within the heater housing 18 whereby the air is sufficiently heated. In order to provide the heat input for the air, a cartridge type heater, not shown, is axially inserted into the open end 22 of the tubular member 20 and disposed within a heater cartridge cavity 36 defined within the tubular member 20.

Returning then to the system 10 disclosed within FIG. 1, the heater block 14 also has disposed therein a temperature sensor 38 which senses the temperature of the heater block 14 and controls the energization of the heaters 16,16 accordingly. The heated air HAO, after exiting from the heater block 14 is conducted or distributed toward the adhesive dispensing modules 40 by means of a common conduit 42 and a plurality of branch conduits 44,46,48,50. As may readily be appreciated, however, this structural system poses several operative drawbacks or disadvantages. Firstly, it is noted that due to the different distances, for example, of the conduits 44 and 50 from the common conduit 42, relative to the distances of the conduits 46 and 48 from the common conduit 42, non-uniform distribution of the heated air to the various conduits can occur. Secondly, due to the fact that the temperature sensor 38 is in effect embedded within the heater block 14 and is not disposed within the heated air stream, only poor or unreliable temperature control of the air stream is achieved.

With reference now being made to FIG. 2, a second conventionally known and utilized system is illustrated and is generally indicated by the reference character 110. The system 110 is seen to comprise an inlet conduit 112 for introducing relatively cold ambient air into a heated block 114. In particular, the incoming relatively cold ambient air stream 112 is initially divided or distributed into separate air streams which are conducted through branch conduits 144, 146,148,150. The air streams or conduits 144,146,148,150 respectively pass through the heated block 114 such that the separate air streams are heated within the heated block 114. The heated air streams are then conducted by means of the conduits 144,146,148,150 to the adhesive dispensing modules 140.

While the system of FIG. 2 appears to have resolved the problem of dividing the heated air stream into multiple heated branched air streams and the resulting non-uniform distribution characteristics of the same, non-uniform temperature levels or gradients can nevertheless exist within the conduits 144,146,148,150 of the heated block 114 which can of course result in the creation of non-uniform temperature levels within, and heating of, the air streams. In addition to non-uniform fluidic transmission characteristics that may be inherent within the air stream passages defined by the conduits 144,146,148,150, one of the major factors contributing to the creation of such non-uniform temperature levels within the individual air streams and conduits 144,146,148, 150 is the embedded disposition of the single temperature sensor 138 within the heated block 114 whereby it is not possible to accurately control the temperature level within each one of the air streams passing through the conduits 144,146,148,150.

A need therefore exists in the art for a new and improved system, and a method of operating the same, wherein the air streams supplied to the dispensing modules can be heated to a desired temperature level, wherein the temperature levels of the air streams supplied to the dispensing modules can be rendered uniform, wherein the temperature levels of the air streams supplied to the dispensing modules can be properly and accurately controlled, and wherein the air stream flow rates provided to the dispensing modules can effectively be rendered uniform.

OBJECTS OF THE INVENTION

Accordingly, it is an object of the present invention to provide a new and improved air preheater system, and a method of operating the same, for use in connection with the requisite supply of heated air streams to the dispensing modules of apparatus or systems for dispensing hot melt adhesives.

Another object of the present invention is to provide a new and improved air preheater system, and a method of operating the same, for use in connection with the requisite supply of heated air streams to the dispensing modules of apparatus for dispensing hot melt adhesive wherein the various drawbacks and operative disadvantages of the known PRIOR ART systems, as discussed hereinbefore, are effectively overcome.

An additional object of the present invention is to provide a new and improved air preheater system, and a method of operating the same, for use in connection with the requisite supply of heated air streams to the dispensing modules of apparatus for dispensing hot melt adhesive wherein non-uniform temperature levels, density, and flow rate parameters characteristic of the various air streams conducted to the hot melt adhesive dispensing modules are effectively eliminated.

A further object of the present invention is to provide a new and improved air preheater system, and a method of operating the same, for use in connection with the requisite supply of heated air streams to the dispensing modules of apparatus for dispensing hot melt adhesive wherein the air streams supplied to the hot melt adhesive dispensing modules can be heated to a desired temperature level, wherein the temperature levels of the air streams supplied to the hot melt adhesive dispensing modules can effectively be rendered uniform, wherein the temperature levels of the air streams supplied to the hot melt adhesive dispensing modules can be properly and accurately controlled, and wherein the flow rates of the air streams provided to the hot melt adhesive dispensing modules can effectively be rendered uniform.

SUMMARY OF THE INVENTION

The foregoing and other objectives are achieved in accordance with the principles and teachings of the present invention through the provision of a new and improved air preheater system, and a method of operating the same, for use in connection with the requisite supply of heated air streams to the dispensing modules of apparatus for dispensing hot melt adhesives wherein the system comprises the initial separation of the incoming ambient relatively cool air into separate air streams. The separate air streams are then individually and separately heated, and the exiting or discharged heated air streams are then recombined into a single heated air stream. In this manner, any variations in the temperature levels, density, and flow rate parameters within the individual or separate heated air streams are therefore averaged out and effectively eliminated. The single heated air stream is then conducted to a distribution manifold wherein unique structure of the distribution manifold renders uniform distribution of the separate air streams to the hot melt adhesive dispensing modules possible. In addition, in order to properly control the temperature level to which the individual air streams are initially heated, a temperature sensor is placed within the single combined air stream at a location upstream of the distribution manifold.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
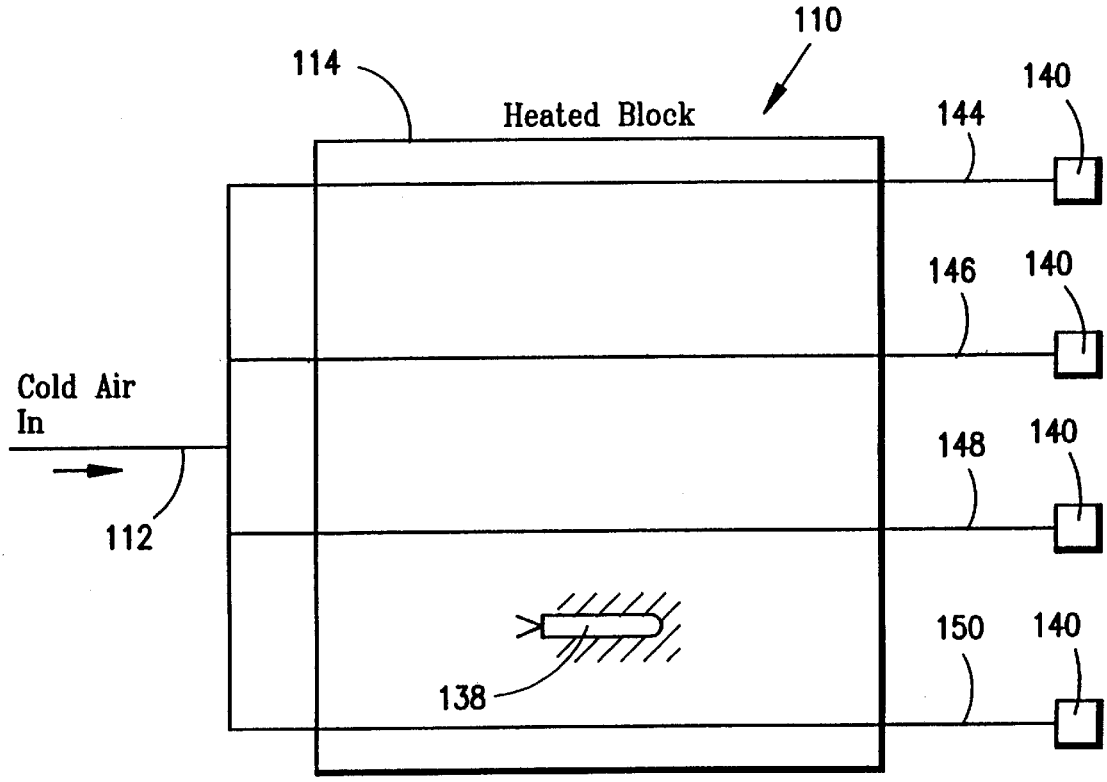
FIG. 2 (PRIOR ART)
FIG. 2 is a schematic drawing of a second embodiment of a PRIOR ART air preheater system used in connection with the supply of preheated air streams to the dispensing modules of a hot melt adhesive dispensing system.
Figure 3:
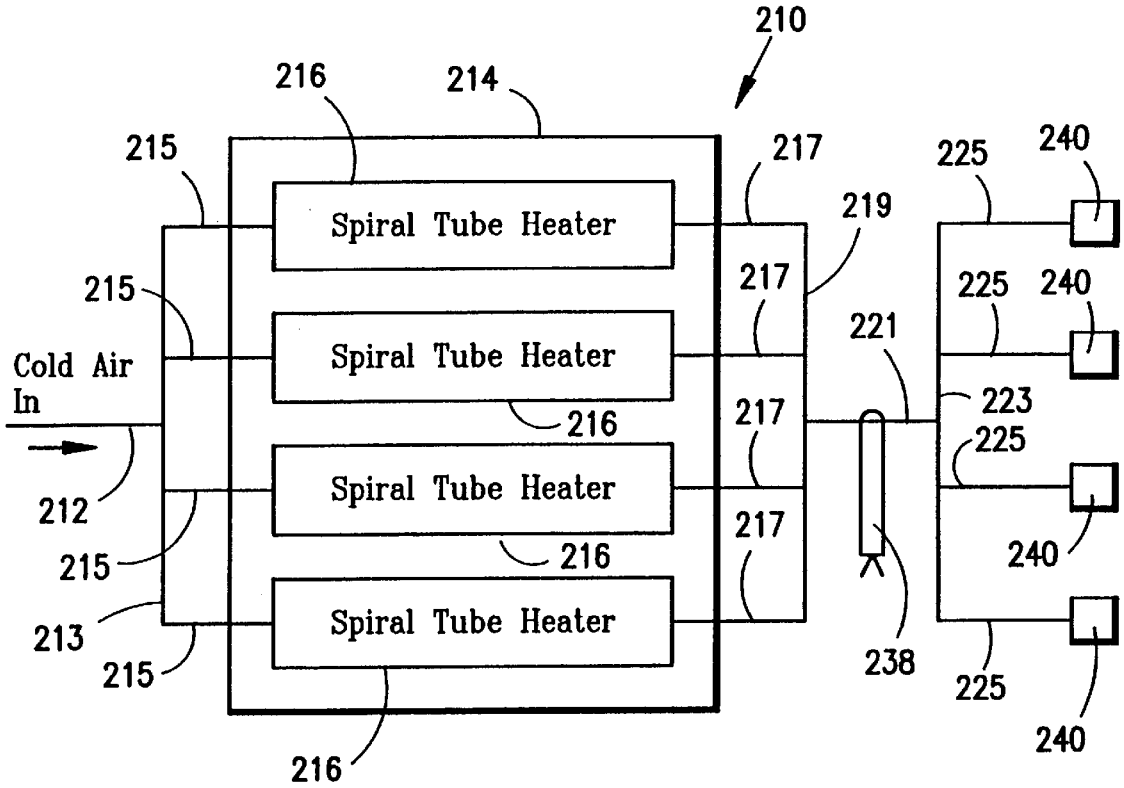
FIG. 3 is a schematic drawing of a first embodiment of a new and improved air preheater system, constructed in accordance with the principles and teachings of the present invention, for use in connection with the supply of preheated air streams to the dispensing modules of a hot melt adhesive dispensing system.

Referring now to the drawings, and more particularly to FIG. 3 thereof, a first embodiment of the new and improved air preheater system, constructed in accordance with the principles and teachings of the present invention, and for use in connection with the supply of preheated air streams to the dispensing modules of a hot melt adhesive dispensing system in accordance with the method of the present invention, is illustrated and is generally indicated by the reference character 210. It is initially noted that the system 210 of the present invention is somewhat similar to the PRIOR ART systems illustrated in FIGS. 1 and 2 in that all of the systems employ some common or corresponding types of structural components. Therefore, such similar components will be designated by similar or corresponding reference characters except that the reference characters used in FIG. 3 in connection with the first embodiment of the system, and the method of operating the same, constructed in accordance with the principles and teachings of the present invention will be in the 200 series.

Figure 5:
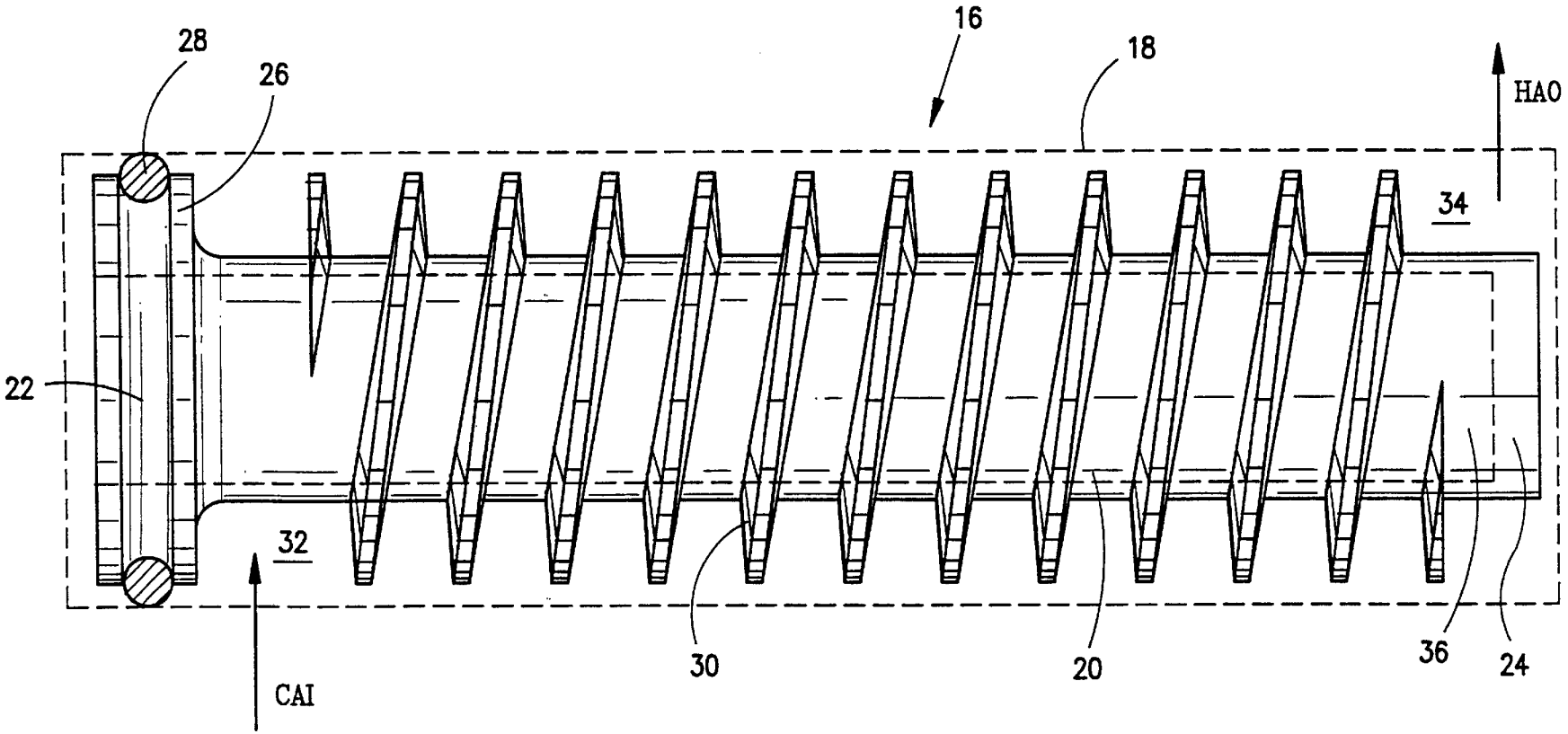
FIG. 5 (PRIOR ART)
FIG. 5 is a side elevational view of a PRIOR ART spiral tube heater used within the PRIOR ART system disclosed within FIG. 1.

More particularly, it is seen that relatively cool ambient air is introduced into the system 210 by means of an inlet conduit 212, and the downstream end of the inlet conduit 212 is fluidically connected to an inlet manifold 213 having a single inlet port and a plurality of outlet ports such that the incoming air stream is divided into a plurality of separated air streams. A plurality of manifold conduits 215,215,215,215 are fluidically connected at their upstream end portions to the inlet manifold 213 and are fluidically connected at their downstream end portions to a plurality of spiral tube heaters 216,216,216,216 so as to be able to respectively conduct the separated air streams to the spiral tube heaters 216,216,216,216. Each one of the spiral tube heaters 216 may be of the same construction as that illustrated in FIG. 5 which was previously discussed hereinbefore. It is also noted that the particular number of spiral tube heaters 216 employed or disposed within the housing 214 for preheating the air streams is dependent upon the width or size of the hot melt adhesive applicator head, not shown, with which the hot melt adhesive dispensing modules .240,240,240,240 are operatively associated.

The spiral tube heaters 216,216,216,216 are disposed within a housing 214, and a plurality of heater conduits 217,217,217,217 are respectively fluidically connected at their upstream end portions to the spiral tube heaters 216, 216,216,216 while the downstream end portion of each one of the heater conduits 217 is fluidically connected to an outlet manifold 219 having a plurality of inlet ports and a single outlet port. As a result of the provision of the heater conduits 217,217,217,217, and their common fluidic connection to the single outlet manifold 219, it is appreciated that the initially separated heated air streams, having passed through the separate spiral tube heaters 216,216,216, 216, are now recombined within the outlet manifold 219.

It is thus apparent that as a result of such recombination of the plurality of preheated air streams, respectively exiting the spiral tube heaters 216,216,216,216 and conducted or passed through the heater conduits 217,217, 217,217, any temperature level, density, or flow rate parameter discrepancies, variants, or gradients existing within such air streams with respect to each other will in effect be averaged out or effectively cancelled whereby new composite temperature level, density, and flow rate parameters will be exhibited, presented, and characteristic of the new single preheated air stream exiting from the outlet manifold 219 through means of an outlet manifold conduit 221. The single preheated air stream can then be distributed to the hot melt adhesive dispensing modules 240,240,240,240 whereby it can readily be appreciated that each one of the hot melt adhesive dispensing modules 240,240,240,240 receives a portion of the same preheated air stream such that each air stream received by a particular one of the hot melt adhesive dispensing modules 240,240,240,240 has substantially precisely the same temperature, density, and flow rate parameters as the air stream received by any one of the other hot melt adhesive dispensing modules 240,240,240,240.

Figure 6:
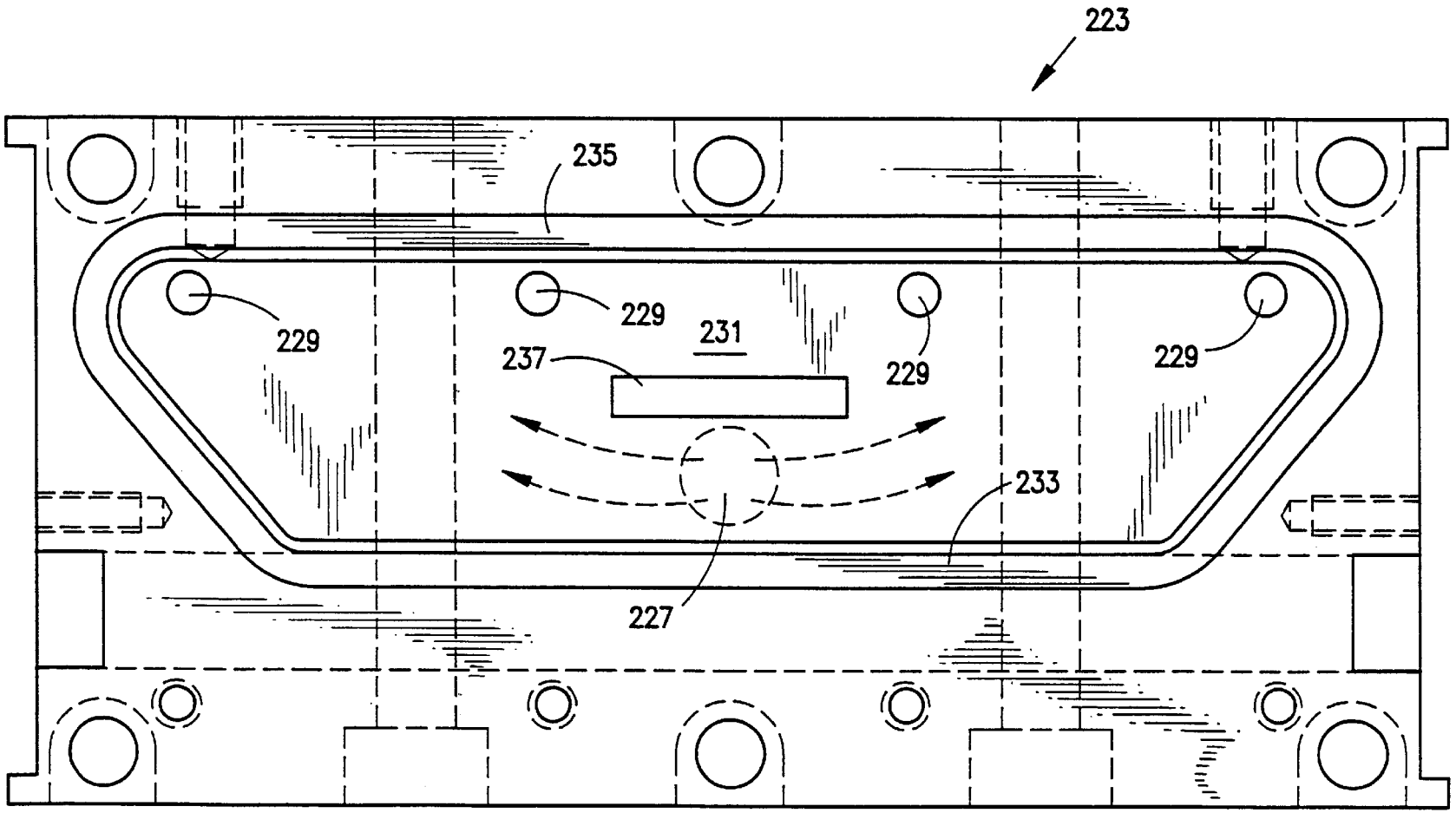
FIG. 6 is an end elevational view of a distribution manifold used within the system of FIG. 3 so as to uniformly distribute the preheated air streams to the dispensing modules of a hot melt adhesive dispensing system.

More particularly, the downstream end of the outlet manifold conduit 221 is fluidically connected to a distribution manifold 223 which serves to separate the single preheated air stream into a plurality of preheated air streams for conveyance to the hot melt adhesive dispensing modules 240,240,240,240, and it is seen that a plurality of distribution manifold conduits 225,225,225,225 fluidically interconnect the distribution manifold 223 to the individual hot melt adhesive dispensing modules 240,240,240,240. In order to provide for a uniform distribution of the separated preheated air streams to the individual hot melt adhesive dispensing modules 240,240,240,240, the distribution manifold 223 is provided with unique structure as disclosed within FIG. 6.

More specifically, the distribution manifold 223 comprises a substantially centrally located inlet port 227 which is fluidically connected to the downstream end of the outlet manifold conduit 221, and a plurality of outlet ports 229, 229,229,229 which are fluidically connected to the upstream ends of the distribution manifold conduits 225,225, 225,225. The inlet port 227 and the outlet ports 229,229, 229,229 are fluidically connected to an internal chamber 231 defined within the distribution manifold 223 wherein the chamber 231 is seen to have a substantially inverted trapezoidal cross-sectional configuration comprising a relatively short longitudinal side 233 and a relatively long longitudinal side 235.

The inlet port 227 is disposed adjacent to the relatively short longitudinal side 233 and the outlet ports 229,229, 229,229 are disposed adjacent to the relatively long longitudinal side 235. This arrangement is critically important in that as the preheated air stream comes into the inlet port 227 of the distribution manifold 223 from the outlet manifold conduit 221, the increasing cross-sectional configuration or volume of the chamber 231 serves to prevent any pressure drop from occurring within the air stream whereby air streams delivered to the outlet ports 229,229, 229,229 have substantially uniform flow properties. A baffle 237 is also provided internally within the distribution manifold chamber 231 for forcing the incoming air stream, passing through inlet port 227, to be distributed laterally outwardly such that the air stream can be evenly distributed between the plurality of outlet ports 229,229,229,229 as opposed to the incoming air stream otherwise readily having the tendency to migrate directly upward above the inlet port 227 and toward the two centrally located outlet ports 229, 229.

With reference again being made to the system 210 of the present invention as disclosed in FIG. 3, another critical feature of the present invention system 210 that should be particularly appreciated is the fact that the temperature sensor 238 is actually disposed within the single preheated air stream flowing through outlet manifold conduit 221. In this manner, real temperature values indicative of the recombined or composite air stream can be readily determined or detected by means of the temperature sensor 238 whereby the spiral tube heaters 216,216,216,216 can be more accurately controlled so as to in turn accurately heat the air streams flowing therethrough and maintain the temperature of the air streams at the desired temperature level.

Figure 1:
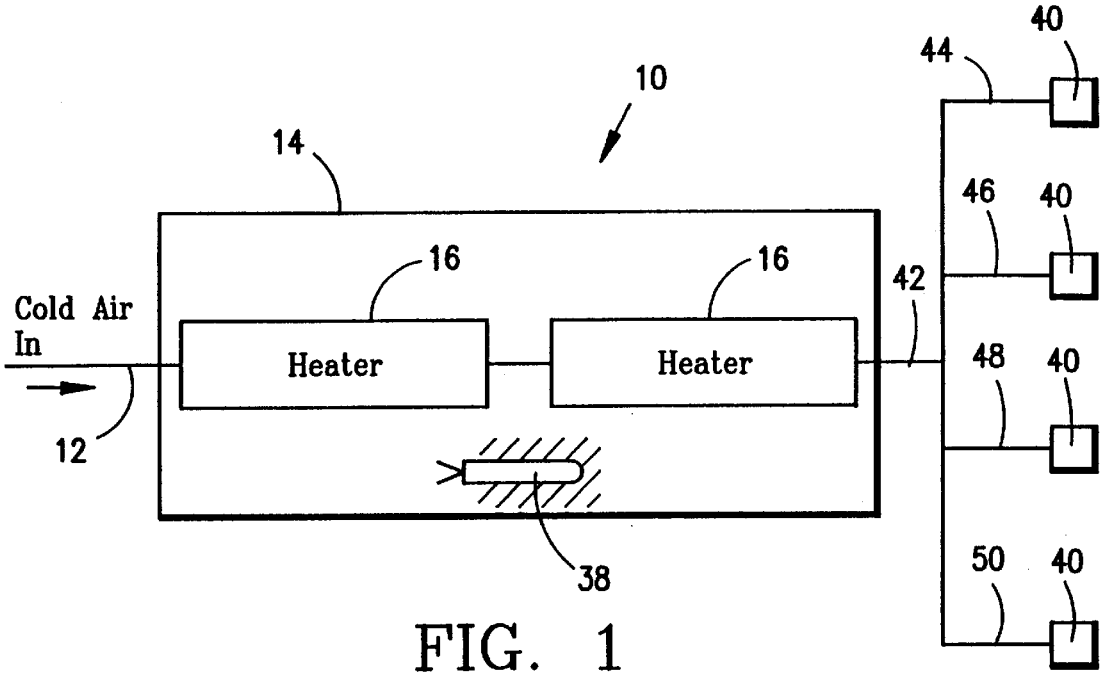
FIG. 1 (PRIOR ART)
FIG. 1 is a schematic drawing of a first embodiment of a PRIOR ART air preheater system used in connection with the supply of preheated air streams to the dispensing modules of a hot melt adhesive dispensing system.
Figure 4:
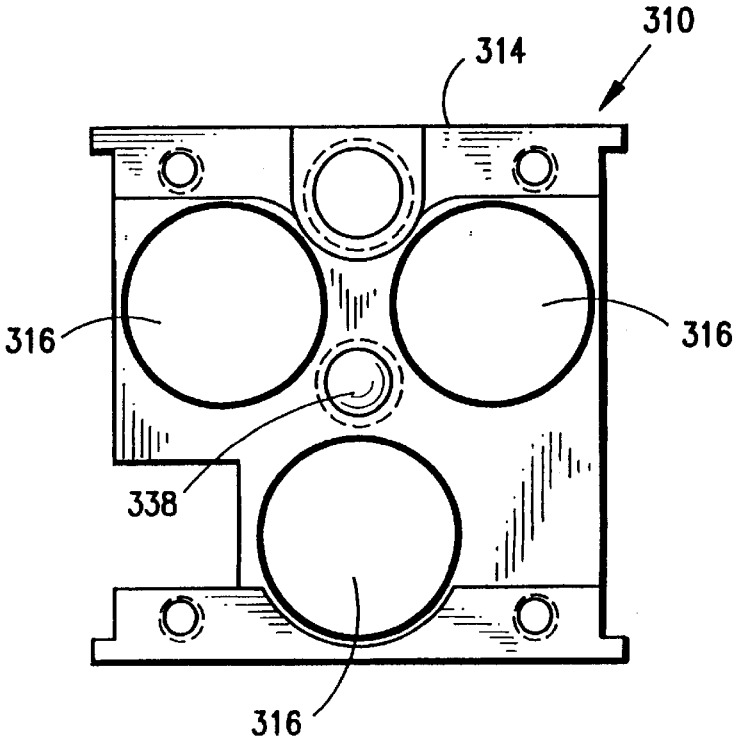
FIG. 4 is an end elevational view of a second embodiment of an air preheater system, constructed in accordance with the principles and teachings of the present invention, for use in connection with the supply of preheated air streams to the dispensing modules of a hot melt adhesive dispensing system.

With reference lastly being made to FIG. 4, in view of the fact that, in accordance with the teachings and principles of the present invention, the temperature sensor 238 is disposed within the recombined air stream 221, as illustrated in FIG. 3 in connection with the first embodiment of the present invention, as opposed to being disposed within the block 14 or the heated block 114 as disclosed in connection with the PRIOR ART embodiments as illustrated within FIGS. 1 and 2, a potential concern has been discussed in connection with the possible overheating of the system, and in particular with respect to the overheating of the spiral tube heaters 216, 216,216,216 and housing 214, under no-flow conditions, that is, when air is not being conducted through the system and yet the spiral tube heaters 216,216,216,216 have been energized. In order to counteract any such tendency or potential overheating of the system, an advantageous arrangement of the various components of the system has been developed and is disclosed as a second embodiment of the present invention in FIG. 4. It is noted that the components of the system illustrated in FIG. 4, which are similar or correspond to the components of the system 210 illustrated in FIG. 3, are designated by similar or corresponding reference characters except that the reference characters are in the 300 series.

More particularly, the hot melt adhesive air preheating system comprising the aforenoted second embodiment of the present invention is illustrated in FIG. 4, is generally indicated by the reference character 310, and is seen to comprise a housing 314 within which are disposed three spiral tube heaters 316,316,316. The spiral tube heaters 316,316,316 are spaced from each other and are disposed within a substantially triangular array, and a temperature sensor 338 is disposed at the center of the triangular array of the spiral tube heaters 316,316,316 with the axes of the spiral tube heaters 316,316,316 and the temperature sensor 338 being disposed parallel to each other. It is noted that with this particular arrangement of the spiral tube heaters 316,316, 316 and temperature sensor 338, the tip portion of the temperature sensor 338 will nevertheless be disposed within the recombined air stream, not shown, in accordance with the principles and teachings of the present invention as have been fully discussed hereinbefore.

In addition, as a result of this particular arrangement of the spiral tube heaters 316,316,316 and the temperature sensor 338, should the spiral tube heaters 316, 316,316 be energized under no-flow conditions, that is, when air is not flowing through the system, heat from the spiral tube heaters 316, 316,316 will in fact be conducted to, or will migrate toward, the temperature sensor 338 under convection or radiation principles whereby the energization of the spiral tube heaters 316,316,316 will be controlled at a substantially predetermined temperature level such that overheating of the system does not in fact occur. It is also to be noted that while the second embodiment of the present invention, as disclosed in FIG. 4, comprises the disposition of three spiral tube heaters 316,316,316 within the housing 314, a greater or lesser number of spiral tube heaters can of course be employed.

Thus, it may be seen that in accordance with the principles and teachings of the present invention, the arrangement of the various components of the system permit individual incoming ambient air streams to be separately, individually, and independently heated, and subsequently, such separately and independently heated air streams are recombined into a single composite air stream such that any temperature, density, and flow rate differentials, variants, or gradients that previously existed within the separate or individual air streams are averaged out. The single recombined air stream is then divided into separate air streams so as to be conducted to the hot melt adhesive dispensing modules. In addition, the temperature sensor is located in the recombined composite air stream so as to accurately control the spiral tube heaters in accordance with actually sensed temperature values of the recombined composite air stream which is to be supplied to the hot melt adhesive dispensing modules.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An air preheater system for heating air to be used in connection with the dispensing of viscous materials, comprising:

a first conduit for introducing a relatively cold air stream into said system;

first means for dividing said relatively cold air stream into a plurality of separate air streams;

means for heating said plurality of separate air streams to a predetermined temperature level;

second means for recombining said plurality of separate heated air streams into a single heated air stream; and third means for dividing said single heated air stream into a plurality of heated air streams for conveyance to dispensing means for use in connection with the dispensing of viscous materials.

2. The system as set forth in claim 1, wherein:

said means for heating said plurality of separate air streams comprises a spiral tube heater.

3. The system as set forth in claim 2, wherein said spiral tube heater comprises:

a housing;

a hollow tubular member disposed within said housing;

a cartridge heater disposed internally within said hollow tubular member; and a helical finned member disposed upon an external surface portion of said hollow tubular housing for defining, with an internal surface portion of said housing, a helical flow path for an air stream introduced into a first end of said housing and discharged from a second opposite end of said housing.

4. The system as set forth in claim 1, wherein:

said means for heating said plurality of separate air streams comprises a plurality of spiral tube heaters for separately and independently heating each one of said plurality of separate air streams.

5. The system as set forth in claim 4, wherein each one of said spiral tube heaters comprises:

a housing;

a hollow tubular member disposed within said housing;

a cartridge heater disposed internally within said hollow tubular member; and a helical finned member disposed upon an external surface portion of said hollow tubular housing for defining, with an internal surface portion of said housing, a helical flow path for an air stream introduced into a first end of said housing and discharged from a second opposite end of said housing.

6. The system as set forth in claim 1, wherein:

said first means for dividing said relatively cold air stream into a plurality of separate air streams comprises an inlet manifold having a single inlet port and a plurality of outlet ports.

7. The system as set forth in claim 1, wherein:

said second means for recombining said plurality of separate heated air streams into a single heated air stream comprises an outlet manifold having a plurality of inlet ports and a single outlet port.

8. The system as set forth in claim 7, wherein:

said third means for dividing said single heated air stream into a plurality of heated air streams comprises a distribution manifold having a single inlet port and a plurality of outlet ports.

9. The system as set forth in claim 8, wherein:

said distribution manifold has a substantially inverted trapezoidal cross-sectional configuration comprising a relatively short longitudinal side and a relatively long longitudinal side;

said single inlet port is disposed adjacent to said relatively short longitudinal side; and said plurality of outlet ports are disposed adjacent to said relatively long longitudinal side, whereby a pressure drop, within said plurality of heated air streams as said plurality of heated air streams move from said single inlet port toward said plurality of outlet ports, is effectively prevented.

10. The system as set forth in claim 8, further comprising:

a second conduit fluidically interconnecting said outlet manifold and said distribution manifold; and a temperature sensor disposed within said second conduit so as to directly sense the temperature of said single heated recombined air stream.

11. The system as set forth in claim 10, wherein:

said means for heating said plurality of separate air streams comprises a plurality of spiral tube heaters for separately and independently heating each one of said plurality of separate air streams;

said plurality of spiral tube heaters are disposed within a geometrical array; and said temperature sensor is disposed at a substantially central position of said array of plurality of spiral tube heaters so as to properly control the energization of said spiral tube heaters even under no-flow air stream conditions.

12. An air preheater system for heating air to be used in connection with the dispensing of hot melt adhesive materials, comprising:

a first conduit for introducing a relatively cold air stream into said system;

first means for dividing said relatively cold air stream into a plurality of separate air streams;

means for heating said plurality of separate air streams separately and independently to a predetermined temperature level;

second means for recombining said plurality of separate heated air streams into a single heated air stream such that any differentials in temperature, density, and flow rates present within said plurality of separate heated air streams are averaged out; and third means for dividing said single heated air stream into a plurality of heated air streams for conveyance to hot melt adhesive dispensing modules for use in connection with the dispensing of said hot melt adhesive materials.

13. The system as set forth in claim 12, wherein:

said means for heating said plurality of separate air streams comprises a spiral tube heater.

14. The system as set forth in claim 13, wherein said spiral tube heater comprises:

a housing;

a hollow tubular member disposed within said housing;

a cartridge heater disposed internally within said hollow tubular member; and a helical finned member disposed upon an external surface portion of said hollow tubular housing for defining, with an internal surface portion of said housing, a helical flow path for an air stream introduced into a first end of said housing and discharged from a second opposite end of said housing.

15. The system as set forth in claim 12, wherein:

said means for heating said plurality of separate air streams comprises a plurality of spiral tube heaters for individually heating each one of said plurality of separate air streams.

16. The system as set forth in claim 15, wherein each one of said spiral tube heaters comprises:

a housing;

a hollow tubular member disposed within said housing;

a cartridge heater disposed internally within said hollow tubular member; and a helical finned member disposed upon an external surface portion of said hollow tubular housing for defining, with an internal surface portion of said housing, a helical flow path for an air stream introduced into a first end of said housing and discharged from a second opposite end of said housing.

17. The system as set forth in claim 12, wherein:

said first means for dividing said relatively cold air stream into a plurality of separate air streams comprises an inlet manifold having a single inlet port and a plurality of outlet ports.

18. The system as set forth in claim 13, wherein:

said second means for recombining said plurality of separate heated air streams into a single heated air stream comprises an outlet manifold having a plurality of inlet ports and a single outlet port.

19. The system as set forth in claim 18, wherein:

said third means for dividing said single heated air stream into a plurality of heated air streams comprises a distribution manifold having a single inlet port and a plurality of outlet ports.

20. The system as set forth in claim 19, wherein:

said distribution manifold has a substantially inverted trapezoidal cross-sectional configuration comprising a relatively short longitudinal side and a relatively long longitudinal side;

said single inlet port is disposed adjacent to said relatively short longitudinal side; and said plurality of outlet ports are disposed adjacent to said relatively long longitudinal side, whereby a pressure drop, within said plurality of heated air streams as said plurality of heated air streams move from said single inlet port toward said plurality of outlet ports, is effectively prevented.

21. The system as set forth in claim 19, further comprising:

a second conduit fluidically interconnecting said outlet manifold and said distribution manifold; and a temperature sensor disposed within said second conduit so as to directly sense the temperature of said single heated recombined air stream.

22. The system as set forth in claim 21, wherein:

said means for heating said plurality of separate air streams comprises a plurality of spiral tube heaters for separately and independently heating each one of said plurality of separate air streams;

said plurality of spiral tube heaters are disposed within a geometrical array; and said temperature sensor is disposed at a substantially central position of said array of plurality of spiral tube heaters so as to properly control the energization of said spiral tube heaters even under no-flow air stream conditions.

23. A method for preheating air to be used in connection with the dispensing of hot melt adhesive materials, comprising the steps of:

introducing a relatively cold air stream into a fluidic system;

dividing said relatively cold air stream into a plurality of separate air streams;

heating said plurality of separate air streams separately and independently to a predetermined temperature level;

recombining said plurality of separate heated air streams into a single heated air stream such that any differentials in temperature, density, and flow rates present within said plurality of separate heated air streams are averaged out; and dividing said single recombined heated air stream into a plurality of heated air streams for conveyance to hot melt adhesive dispensing modules for use in connection with the dispensing of said hot melt adhesive materials.

24. The method as set forth in claim 23, wherein said step of heating said plurality of air streams separately and independently to a predetermined temperature level comprises the step of:

conducting each one of said air streams respectively through one of a plurality of spiral tube heaters.

25. The method as set forth in claim 24, wherein said step of conducting each one of said air streams respectively through one of a plurality of spiral tube heaters comprises the steps of:

conducting each one of said air streams into a first end of a respective one of said plurality of spiral tube heaters;

conducting each one of said air streams around a helical finned member of each one of said sprial tube heaters such that each one of said air streams is conducted along a helical flow path within each one of said spiral tube heaters such that the residence time of each one of said air streams within each one of said spiral tube heaters is enhanced; and discharging each one of said heated air streams from a second opposite end of each one of said spiral tube heaters.

26. The method as set forth in claim 23, wherein the step of dividing said single heated air stream into a plurality of heated air streams for conveyance to said hot melt adhesive dispensing modules comprises the step of:

conducting said single heated air stream into a distribution manifold having a substantially inverted trapezoidal cross-sectional configuration, comprising a relatively short longitudinal side and a relatively long longitudinal side, wherein a single inlet port is disposed adjacent to said relatively short longitudinal side, and a plurality of outlet ports are disposed adjacent to said relatively long longitudinal side, whereby a pressure drop, within said plurality of heated air streams as said plurality of heated air streams move from said single inlet port toward said plurality of outlet ports, is effectively prevented.

27. The method as set forth in claim 24, further comprising the step of:

disposing a temperature sensor within said single heated recombined air stream so as to directly sense the temperature of said single heated recombined air stream.

28. The method as set forth in claim 27, further comprising the steps of:

arranging said plurality of spiral tube heaters within a geometrical array; and disposing said temperature sensor at a substantially central position of said geometrical array of plurality of spiral tube heaters so as to properly control the energization of said spiral tube heaters even under no-flow air stream conditions.

* * * * *